United States Patent [19]

Lipschutz

[11] 4,270,229

[45] Jun. 2, 1981

[54] METHOD OF SURFACE ORNAMENTED CAP

[75] Inventor: Charles Lipschutz, Louisville, Ky.

[73] Assignee: Louisville Manufacturing Co., Inc., Louisville, Ky.

[21] Appl. No.: 113,129

[22] Filed: Jan. 17, 1980

[51] Int. Cl.[3] ..... A42B 1/02

[52] U.S. Cl. ..... 2/195; 2/192

[58] Field of Search ..... 2/175, 195, 192; 430/538; 101/426, 463.1, 464; 223/7

[56] References Cited

U.S. PATENT DOCUMENTS

| | | | |
|---|---|---|---|
| 385,297 | 6/1888 | Cohn | 2/192 X |
| 1,274,652 | 8/1918 | Winget | 2/192 |
| 2,431,169 | 11/1947 | Dice | 2/195 X |
| 2,455,735 | 12/1948 | Condax | 101/464 X |

FOREIGN PATENT DOCUMENTS

| | | | |
|---|---|---|---|
| 519751 | 12/1955 | Canada | 430/536 |
| 343088 | 9/1936 | Italy | 2/192 |
| 1215219 | 12/1970 | United Kingdom | 430/538 |

*Primary Examiner*—Louis Rimrodt

*Attorney, Agent, or Firm*—Wenderoth, Lind & Ponack

[57] ABSTRACT

A method of producing a cap having a plurality of tapered panels and surface ornamented so as to have the appearance of a three dimensional object. Photographs of side views of the object are taken from a plurality of positions spaced at equal angles around the object and the same as the number of panels in the cap, and photographs of the top portions of the object corresponding to the number of side views are also taken. There is then cut from each of the side view photographs of the object a piece corresponding to the developed shape of a panel having the lower edge of the image of the object at the position corresponding to the lower edge of the panel in the cap, and there is cut from each of the top portion photographs of the object further pieces corresponding to the tapered portions of corresponding panels. The pieces are joined for forming composites of the panels of the cap with photographic representations of the three dimensional object thereon. The transition areas between the photographic representations on said composites are touched up and then the images of said composites are transferred onto material for panels of the cap and the panels are assembled into the cap.

14 Claims, 8 Drawing Figures

METHOD OF SURFACE ORNAMENTED CAP

This invention relates to a method of producing a surface ornamented cap, and more particularly to a method of making such a cap which has the appearance of a three dimensional article or object.

BACKGROUND OF THE INVENTION AND PRIOR ART

Caps which are formed from a plurality of panels sewn together, and which frequently have visors, are well-known, and have long been produced in various forms and shapes. These caps are usually made of a plurality of panels, having upper portions which are tapered upwardly, and which, when sewn together, form a crown for the hat, on the top of which is placed a button or the like to close the small opening where the apexes of the panels come together at the top of the crown.

It has long been the practice to ornament such caps by placing ornamentation on the respective panels prior to their being sewn together into the cap. However, ornamentation applied by printing or the like must usually be such that it is complete for the respective individual panels, i.e., such that the ornamentation does not overlap the seams between the respective panels. If the preapplied ornamentation overlaps the seams between the panels, problems of registration of the portions of the ornamentation on the opposite sides of the seam arise.

Heretofore, ornamentation which extends across the seams of such a cap has been applied in the form of a separate piece of material, such as an embroidered patch or the like along the lower front portion of the panels just above the visor.

As can be understood, this problem of registration of ornamentation on the different panels of such caps limits rather sharply the different types of ornamentation which can be applied to such caps.

It would be desirable, in order to increase the variety of types of ornamentation which can be applied to such caps, to provide a method for ornamenting such caps with ornamentation which is representative of a three dimensional article or object similar in shape to the cap with good registration between panels.

OBJECTS AND BRIEF SUMMARY OF THE INVENTION

It is accordingly an object of the present invention to provide a method of surface ornamenting a cap formed from a plurality of panels sewn together along seams, which surface ornamentation is a representation of a three dimensional article or object similar in shape to the cap and having portions which cross the seams of the cap with good registration on opposite sides of the seams.

DETAILED DESCRIPTION OF THE INVENTION

The present invention provides a method of giving to a cap the appearance of any three dimensional article which has the general shape of the cap, e.g., a shape having a somewhat cylindrical base and a somewhat flattened hemispherical crown. The described embodiment of the three dimensional article of which the cap is to have the appearance is a hamburger. However, it will be apparent to those skilled in the art that the appearance could be that of many other articles or objects, for example half of a tomato or other similar shaped fruit, a scoop of ice cream in the top of a cone, an ice cream sundae in a cylindrical dish, or the like. Accordingly, the present invention is not limited to the method as applied to a cap having the appearance of a hamburger.

Figure 7:
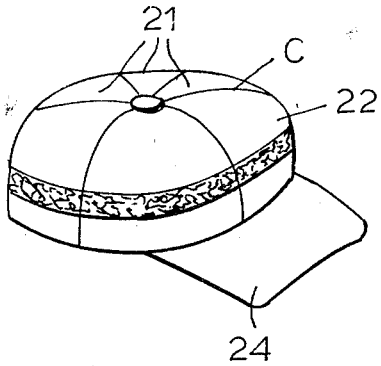
FIG. 7 is a perspective view of a cap formed from a plurality of panels such as shown in FIG. 5.

The cap C, the structure of which is conventional, is shown in FIG. 7, and is composed of a plurality of segmental-shaped panels 21 sewn into a cap crown and a visor 24 attached to the lower edge of the crown.

The first step in the preparation of the cap is to place the article or object on the top of a support means constituted by a generally cylindrical column 10 mounted on a generally circular rotatable base 12. The column 10 has marked on the peripheral surface thereof guide markings 11 which are parallel to the axis of the cylinder. The rotatable base 12 has similar radially extending markings 13 thereon. The markings 11 and the markings 13 are aligned with each other. In the embodiment shown the markings 11 are at angles $\alpha$ of 60°, but they can be smaller angles divisible evenly into 360 if desired. The size of the angles cannot as a practical matter be increased beyond 72°, for a reason which will be described hereinafter.

To the side of the column 10 is positioned a photographic camera 14 spaced from the column a distance such that the field of view of the camera can include the entire object O. The camera 14 is positioned so that the optical axis **14*a* is aligned with the bottom surface of the object O and the top surface of the column 10**.

Figure 1:
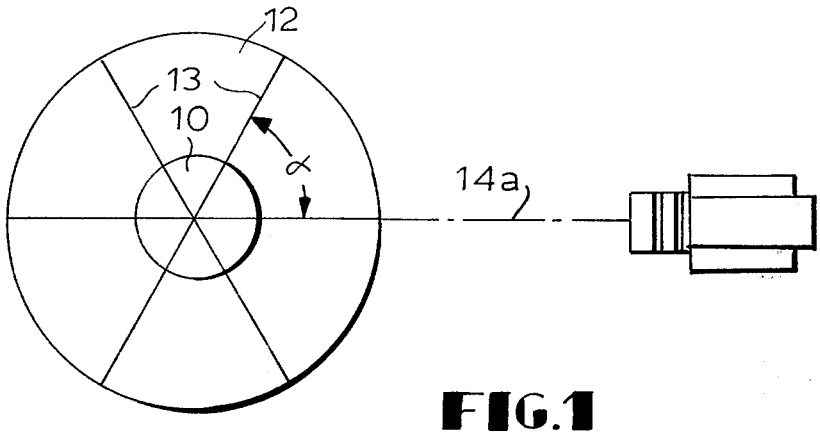
FIG. 1 is a top plan view of an arrangement for holding a three dimensional article or object and photographing it.
Figure 2:
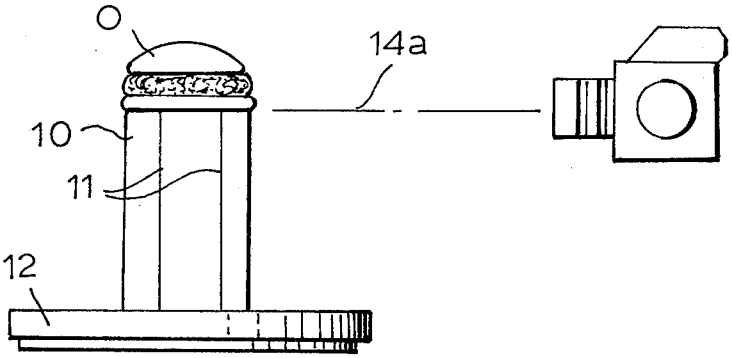
FIG. 2 is a side elevation view of the arrangement of FIG. 1 showing a three dimensional object in position in the arrangement.
Figure 3:
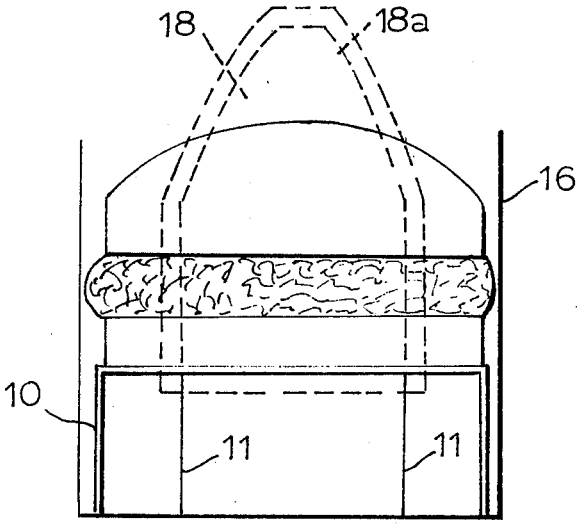
FIG. 3 is a representation of a side view photograph taken with the arrangement of FIGS. 1 and 2 with the outline of a panel of a cap superimposed thereon.

The column 10 and base 12 are rotated until the optical axis **14*a* bisects the angle between guide markings 13, as shown in FIG. 1, and a first photograph 16 as shown in FIG. 3 is taken. This photograph will, because the field of view of the camera at the position as shown in FIGS. 1 and 2 is large enough to include the entire object O, be a side elevation view of the object and will also include the top of the column 10 and the upper ends of the markings 11**.

The column 10 is then rotated through the angle $\alpha$ and another similar photograph of the object O is taken. This process is repeated for all of the angles $\alpha$, in the embodiment shown resulting in six side view pictures which together constitute the periphery of the object.

Figure 4:
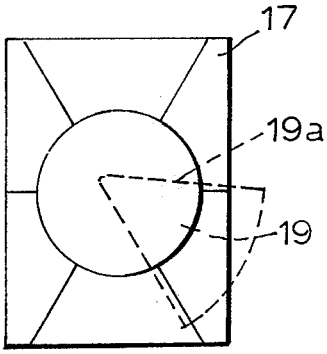
FIG. 4 is a representation of a plan view photograph taken with the arrangement of FIGS. 1 and 2 with the outline of a portion of the panel of a cap superimposed thereon.

Thereafter the camera 14 is moved to a position directly above the central axis of the column 10 and directed downwardly toward the object, and a top portion photograph 17 which is a top plan view of the object is taken, as shown in FIG. 4. Alternatively a second camera could be provided for taking the top plan view of the object.

Prints of each of the side view photographs are made, and six prints of the plan view photographs are made, and there is then cut from each of the respective side views 16 a piece 18 corresponding to the developed shape of one panel of a plurality of such panels making up a cap C, shown in FIG. 7 the number of such panels being equal to $360°/\alpha$, and in the present embodiment being six in number. It will be seen that each piece 18 has at the base thereof a dimension in the direction of the periphery of the cap C which is greater than the periphery of the cap divided by the number of angles $\alpha$ by an amount 18*a* on each edge of the piece 18, which amount 18*a* corresponds to the hem along that edge of the panel. In the case if the piece 18 shown FIG. 3, the points on the piece corresponding to the opposite side edges of the panel are aligned with the markings 11 on the column, and the lower edge is aligned with the bottom of the object O, corresponding to the top of the column. The portions 18*a* project beyond the markings 11. It will of course be understood that the peak of the developed shape of the panel projects upwardly beyond the top of the object O as it appears in the photograph 16. This portion is eventually replaced by a portion of the photograph 17 shown in FIG. 4, as will be described hereinafter.

Moreover, it is not practical to make the angle $\alpha$ larger than 72°, which will result in five side view photographs and five panels, because it is not practical to make a cap less than five panels.

Figure 5:
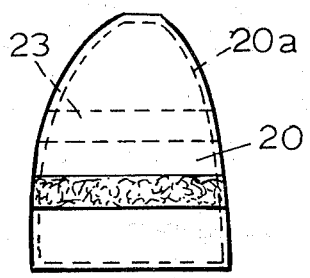
FIG. 5 is a plan view of a photographic representation having the shape of a panel of a cap made from the combination of pieces of the photographs of FIGS. 3 and 4.

Then there is cut from each of the six plan view photographs 17 as shown in FIG. 4 pieces 19 corresponding to the upper or tapered portion of the panels together with portions 19*a*. These pieces are then joined with the pieces 18 cut from the corresponding side views 16 to add thereto a representation of a segment of the object in the peak portion of the pieces cut from the side view photographs. The resulting photographic composite 20 is shown in FIG. 5 with the portions 20*a* therearound corresponding to the hem of the finished panel.

As can be seen from FIG. 7, the actual panels 21 which are formed into the cap are curved at 22 so that the top of the cap is in the shape of a flattened hemisphere. Naturally the object which the cap is to represent will have a somewhat similar, although not necessarily identical, curved portion thereon, and in both the side view photographs 16 and the plan view photographs, this portion will be somewhat distorted. In the resulting composite 20 shown in FIG. 5, this area is shown at 23 and constitutes a transition area which cannot be completely accurately represented when only a side view and a plan view photograph are used. Accordingly, the next step after obtaining the respective composites 20 corresponding to the panels of the cap is to retouch the transition areas 23 so that when these areas are curved at 22 in the finished cap, they will not have a distorted appearance.

Figure 9:
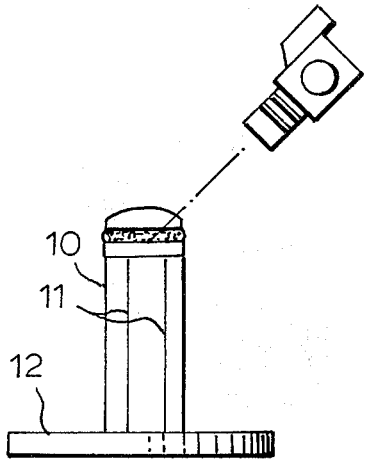

It is of course possible to repeat the taking of the photographs with the camera 14 directed obliquely downwardly as shown in FIG. 9 to provide oblique views of the transition areas. Oblique view pieces can be cut from these views in the same manner as the side view pieces, and they can be inserted in the transition areas 23 of the respective pieces 20 and the smaller transition areas between the three pieces retouched.

It is also possible to take such oblique views at a sufficiently small angle to the vertical that they are really top portion views and when such oblique view pieces are cut therefrom and assembled, they are similar to a top plan view. For articles which have a crown which is somewhat more conical than flattened, the use of such oblique views as the top portion views may be preferable to a top plan view.

The thus retouched composites corresponding to the respective panels of the cap are then prepared, in a conventional way, for transfer onto the panels of material which are to be assembled into the cap. Multicolor printing techniques for reproducing images on cloth or similar materials commonly used in caps of this type can be used, but it is preferred to use a sublimation process for directly sublimating the image of the respective panels directly onto the material of the panels in a single sublimating operation. A number of such techniques are known in the art which are useful in the mass production of panels for caps carrying such surface decoration, and they will not be decribed further in detail here.

Figure 6:
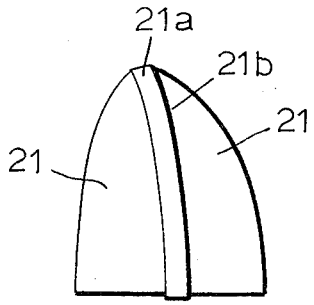
FIG. 6 is a perspective view, taken from the inside, of two panels sewn together to form part of cap.

After the reproduction of the retouched composites 20 have been placed on the surfaces of the material for the panels 21, the panels are sewn together in the conventional manner by placing the panels with the surface decorated sides against each other and stitching along the line 21*b* at which the hem 21*a* joins the main part of the panel 21, and then folding the panels around the stitching until they are in the desired shape, as shown in FIG. 6. After the panels have been sewn together into the crown, a visor 24 may, if desired, be sewn into the hem around the bottom of the crown by conventional techniques.

The completed cap will then have the appearance of the object which was initially photographed, in this case a hamburger, as seen in FIG. 7.

Figure 8:
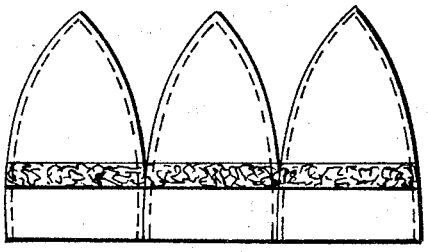
FIG. 8 is a plan view of an assembly of panels for use in forming a cap such as shown in FIG. 7 by an alternative assembly method.

The panels 21 for assembly into the cap are shown in FIG. 6 as being separate panels. It has been found that the assembly of the panels into the cap can be speeded if the panels are joined to each other along the lower vertical edge portions of the base portions of the respective panels, as shown in FIG. 8. FIG. 8 shows only three panels, but it should be understood that three additional panels which together constitute the other side of the crown are joined to the right edge of one of the end panels so that all six panels which together constitute the crown portion of the cap are cut from a single piece of material and are initially joined along the lower vertical edges. The manner of applying the surface ornamentation is identical with the manner of applying it to a single panel, and the description will not be repeated here.

It is also possible, where the panels are joined as in FIG. 8, to omit the portion corresponding to the hem along the edge portions at which the panels are joined, thus eliminating the necessity to form a seam at such a joint.

While the method has been described as being applied to a hat having a somewhat cylindrical base and a somewhat flattened hemispherical crown, it is apparent that by slightly changing the shape of the respective panels, a more nearly hemispherical crown could be made. The method is equally applicable to such a shape.

What is claimed is:

1. A method of producing a cap having a plurality of panels upwardly and inwardly from a base portion, and surface ornamented so as to have the appearance of a three dimensional object, comprising:

preparing photographs of side views of the object from a plurality of positions spaced at equal angles around the object and the same as the number of panels in the cap;

preparing photographs of the top portions of the object corresponding to the number of side views;

cutting from each of the side view photographs of the object a piece corresponding to the developed shape of a panel having a dimension at the base of the piece in the direction of the periphery of the cap which is at least equal to the periphery of the base portion of the cap divided by the number of panels, and having the lower edge of the image of the object at the position corresponding to the lower edge of the panel in the cap;

cutting from each of the top portion photographs of the object further pieces corresponding to the tapered portions of corresponding panels and joining them to the firstmentioned pieces for forming composites of the panels of the cap with photographic representations of the three dimensional object thereon;

touching up the transition areas between the photographic representations on said composites; and transferring images of said composites onto material for panels of the cap and assembling said panels into the cap.

2. The method as claimed in claim 1 in which the step of preparing photographs of the side views of the object comprises placing the object on a rotatable support means and, while holding a camera in a fixed position with the optical axis directed at the object and on a level, rotating the object and stopping the rotation at each position and photographing the object with the camera each time the object is stopped, and the step of preparing photographs of the top portions of the object comprises positioning the camera in a fixed position with the optical axis directed toward the object and oblique to the horizontal at an acute angle to the vertical, again rotating the object and stopping the rotation at the same positions and photographing the object each time the object is stopped.

3. The method as claimed in claim 2 in which said steps of preparing the photographs comprises providing guide markings on said support means indicating the division of said support means into a plurality of equal segments, and when preparing the photograhs of the side and top portion views, rotating the support means until the optical axis of the camera bisects the angle subtending the segment.

4. The method as claimed in claim 3 in which said step of cutting the pieces from the side and top portion views comprises placing the positions on said pieces corresponding to the edges of the panels in alignment with the photographic representations of the guide markings on said support means and cutting the pieces at points spaced from said guide markings to give said pieces a dimension at the base of the pieces in the direction of the periphery of the cap which is greater than the periphery of the cap divided by the number of panels for providing portions on said composites corresponding to hems on said panels.

5. The method as claimed in claim 4 in which the step of transferring the images of the composites onto material for the panels comprises transferring them onto a plurality of panels joined at the base portions.

6. The method as claimed in claim 3 in which said step of cutting the pieces from the side views comprises placing the positions on some of said pieces corresponding to the edges of the panels in alignment with photographic representations of the guide markings on said support means and cutting said pieces at points spaced from said guide markings to give said pieces a dimension at the base of the pieces in the direction of the periphery of the cap which is greater than the periphery of the cap divided by the number of panels for providing portions on said composite corresponding to hems on said panels, cutting the remaining pieces from the photographs along the edges of the shape of the panel at the base of the panel, and the step of transferring the images of the composites onto material for the panels comprises transferring the composites of said pieces and said further pieces onto a plurality of panels joined at the base portions with said composites of said remaining pieces adjacent each other with no hem portions therebetween.

7. The method as claimed in claim 1 in which the step of preparing photographs of the side views of the object comprises placing the object on a rotatable support means and, while holding a camera in a fixed position with the optical axis directed at the object and on a level, rotating the object and stopping the rotation at each position and photographing the object with the camera each time the object is stopped, and the step of preparing photographs of the top portions of the object comprises preparing photographs of a top plan view of the object by photographing the object from directly above and reproducing the single photograph a plurality of times; and said method further comprises preparing oblique views of the object by positioning the camera in a fixed position with the optical axis directed toward the object and oblique to the horizontal, again rotating the object and stopping the rotation at the same positions as when preparing the side views and photographing the object each time the object is stopped, and cutting from each of said oblique views oblique view pieces corresponding to the developed shape of the panel intermediate the firstmentioned pieces and the further pieces and joining said oblique view pieces to said firstmentioned pieces and said further pieces for forming the composites of the panels.

8. A method of producing a cap having a plurality of panels tapered upwardly and inwardly from a base portion, and surface ornamented so as to have the appearance of a three dimensional object comprising:

preparing photographs of side views of the object from a plurality of positions spaced at equal angles around the object and the same as the number of panels in the cap;

preparing photographs of a top plan view of the object equal in number to the number of side views;

cutting from each of the side view photographs of the object a piece corresponding to the developed shape of a panel having a dimension at the base of the piece in the direction of the periphery of the cap which is at least equal to the periphery of the base portion of the cap divided by the number of panels, and having the lower edge of the image of the object at the position corresponding to the lower edge of the panel in the cap;

cutting from each of a plurality of top view photographs of the object at positions therein corresponding to the positions of the respective side views further pieces corresponding to the tapered portions of corresponding panels and joining them to the firstmentioned pieces for forming composites of the panels of the cap with photographic representations of the three dimensional object thereon;

touching up the transition areas between the photographic representations on said composites; and transferring images of said composites onto material for panels of the cap and assembling said panels into the cap.

9. The method as claimed in claim 8, in which said step of preparing photographs of side views of the object comprises placing the object on a rotatable support means and, while holding a camera in a fixed position with the optical axis directed toward the object and on a level, rotating the object and stopping the rotation at each position and photographing the object with the camera each time the object is stopped, and the step of preparing photographs of a top plan view of the object comprises photographing the object from directly above, and reproducing the single photograph a plurality of times.

10. The method as claimed in claim 9 in which said steps of preparing the photographs comprises providing guide markings on said support means indicating the division of said support means into a plurality of equal segments, and when preparing the photographs of the side views, rotating the support means until the optical axis of the camera bisects the angle subtending the segment and with the optical axis of the camera level with the bottom of the object.

11. The method as claimed in claim 10 in which said step of cutting the pieces from the side views comprises placing the positions on said pieces corresponding to the edges of the panels in alignment with the photograhic representations of the guide markings on said support means and cutting the pieces at points spaced from said guide markings to give said pieces a dimension at the base of the pieces in the direction of the periphery of the cap which is greater than the periphery of the cap divided by the number of panels for providing portions on said composites corresponding to hems on said panels.

12. The method as claimed in claim 11 in which said step of cutting the pieces from the plan views comprises placing the positions on said pieces corresponding to the edges of the tapered portions of the panels in alignment with the photographic representations of the guide markings on said support means and cutting the pieces at points spaced from said guide markings to give said pieces a dimension at the tapered portions of the pieces in the direction of the periphery of the cap which is greater than the peripheral dimension of the tapered portions of the pieces for providing portions on said composite corresponding to hems on said panels.

13. The method as claimed in claim 11 or claim 12 in which the step of transferring the images of the composites onto material for the panels comprises transferring them onto a plurality of panels joined at the base portions.

14. The method as claimed in claim 10 in which said step of cutting the pieces from the side views comprises placing the positions on some of said pieces corresponding to the edges of the panels in alignment with photographic representations of the guide markings on said support means and cutting said pieces at points spaced from said guide markings to give said pieces a dimension at the base of the pieces in the direction of the periphery of the cap which is greater than the periphery of the cap divided by the number of panels for providing portions on said composite corresponding to hems on said panels, cutting the remaining pieces from the photographs along the edges of the shape of the panel at the base of the panel, and the step of transferring the images of the composites onto material for the panels comprises transferring the composites of said pieces and said further pieces onto a plurality of panels joined at the base portions with said composites of said remaining pieces adjacent each other with no hem portions therebetween.

* * * * *